United States Patent [19]

Schlüter

[11] 4,272,928

[45] Jun. 16, 1981

[54] ROOF CONSTRUCTION-SUBCEILING ASSEMBLY

[75] Inventor: Wolfram Schlüter, Meerbusch, Fed. Rep. of Germany

[73] Assignee: Armstrong Cork Company, Lancaster, Pa.

[21] Appl. No.: 53,377

[22] Filed: Jun. 29, 1979

[30] Foreign Application Priority Data

Jul. 31, 1978 [DE] Fed. Rep. of Germany ..... 2833487

[51] Int. Cl.[3] ..... E04H 9/00

[52] U.S. Cl. ..... 52/1; 52/22; 52/232

[58] Field of Search ..... 52/22, 232, 1; 49/5, 49/1

[56] References Cited

U.S. PATENT DOCUMENTS

| | | | |
|---|---|---|---|
| Re. 28,453 | 6/1975 | Sandow | 52/232 |
| 2,142,164 | 1/1939 | Young | 52/232 |
| 2,580,540 | 1/1952 | Graves | 52/232 |
| 2,800,965 | 7/1957 | Church | 52/232 |
| 3,409,766 | 11/1968 | Meckler | 52/28 |
| 3,460,299 | 8/1969 | Wilson | 52/28 |
| 3,537,378 | 11/1970 | Daly | 52/1 |
| 3,971,184 | 7/1976 | Van Wagoner | 52/408 |

*Primary Examiner*—Price C. Faw, Jr.
*Assistant Examiner*—Henry E. Raduazo

[57] ABSTRACT

A roof construction-suspended ceiling system consists of a watertight outer layer and a layer of thermal insulation beneath it resting on a metal roof-supporting surface that has a vapor barrier. Below this there is a suspended ceiling system that has insulation placed thereon. The suspended ceiling has openings that will vent the area between the roof construction and the suspended ceiling and the above-said openings may be quickly closed in the event of a fire below the suspended ceiling system.

2 Claims, 3 Drawing Figures

ROOF CONSTRUCTION-SUBCEILING ASSEMBLY

BACKGROUND OF THE INVENTION

1. Field of the Invention

The invention is directed to roof construction and suspended ceiling system and, more particularly, to a fire rated suspended ceiling system.

2. Description of the Prior Art

This invention concerns a roof structure and suspended ceiling system consisting of a roof with a watertight outer layer and a layer of thermal insulation beneath it, resting on a metal roof-supporting surface that has a vapor barrier, plus a suspended ceiling that is suspended from the roof-supporting surface with the ceiling tile supported by suspended rails.

There is already a known roof structure and suspended ceiling system in which the rails that support the ceiling tiles of the suspended ceiling are suspended from a metal corrugated roof-supporting surface. The roof-supporting surface has a layer of sheet gypsum on its upper side and a layer of thermal insulation such as mineral wool above it, and this is sealed by a watertight outer layer. The roof-supporting surface forms a vapor barrier (German Patent Application No. 2,705,032). It is also known that a layer of asphalt can be applied to the roof-supporting surface to form the vapor barrier.

It has been found that in the event of fire, the fire resistance of this system does not meet the 90-minute requirement, despite the layer of sheet gypsum on the roof-supporting surface that forms a heat sink, because the metal roof-supporting surface reaches excessively high temperatures too rapidly.

To prevent this rapid heating of the metal roof-supporting surface in the space beneath the suspended ceiling in the event of fire, a layer of mineral wool could be appplied as thermal insulation to the ceiling tiles of the suspended ceiling, but the disadvantage of this arrangement is that in unfavorable weather conditions, the dew point in the space between the suspended ceiling and the roof-supporting surface could shift, so the suspended ceiling would be exposed to moisture, and this must be avoided at all costs.

To keep the dew point outside the space, even in very cold weather, the layer of thermal insulation on the roof-supporting surface would have to be increased considerably, so that increased cost due to this method would result in a very expensive roof structure and suspended ceiling system.

SUMMARY OF THE INVENTION

The invention is directed to a roof construction and subceiling assembly consisting of a water impermeable outer layer and a heat insulating layer installed below the outer layer, both of which rest on a metal deck which is a vapor barier. Below the metal deck, a subceiling is suspended with ceiling boards supported by suspended supporting runners. A heat insulating layer is installed between the deck and the subceiling. At points of the subceiling determined by ventilation aspects of the ceiling boards, the overlying intermediate insulation material and ceiling boards are lifted to form an air passage between the area below the suspended ceiling and the area between the subceiling and the deck. Ceiling boards are also maintained at these points in a lifted position by a member which will meet, decompose, or otherwise lose its consistency under the influence of heat and that after the decomposition of said member, said ceiling boards together with the overlying insulation layer, will fall into position substantially closing the subceiling and form a fire barrier between the area below the subceiling and the area above the subceiling.

DESCRIPTION OF THE PREFERRED EMBODIMENTS

Figure 1:
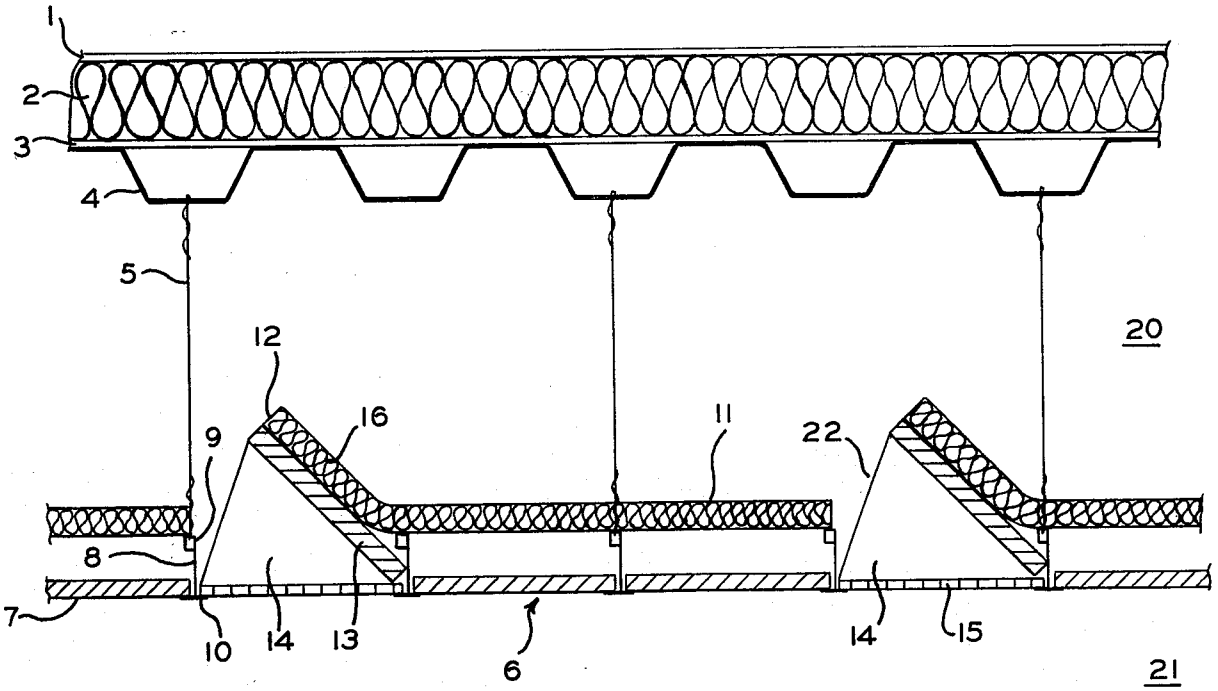
FIG. 1 shows one version of a roof structure and suspended ceiling system in sectional view.

The invention herein is based on the task of designing a roof structure and suspended ceiling system of the type described initially in such a way that with a relatively minor addition of expense in terms of material, fire resistance can be achieved that corresponds at least to the 90-minute limit.

Starting with the roof structure and suspended ceiling system of the type described initially, the problem of fire resistance is solved by adding an intermediate layer of thermal insulation in the space between the roof-supporting surface and the suspended ceiling in such a way that the ceiling tiles and the intermediate insulation material above it are elevated at certain points (determined on the basis of ventilation considerations) to form air passages between the spaces above and below the suspended ceiling. These ceiling tiles are held in raised position by at least one element of a substance that melts, dissolves, or otherwise loses its strength under the influence of heat, in such a way that in the absence of this element, the ceiling tiles and the intermediate insulation material above them will drop into a position sealing the suspended ceiling and intermediate layer, where they are held by means of the supporting rails.

The roof structure and suspended ceiling arrangement, according to this invention, has the advantage that despite the intermediate layer of thermal insulation material, the space between the roof-supported surface and the suspended ceiling is sufficiently ventilated so that there cannot be a shift in the dew point in this space. In the event of a fire in the space beneath the suspended ceiling, the element supporting the upward tilted ceiling tiles dissolves, or otherwise loses it strength very rapidly owing to the heat evolved, so the supporting effect is lost and both the ceiling tiles and intermediate insulation on it drop down under the influence of gravity, so they completely cover the ceiling area previously exposed when they were tilted upward, i.e., completely sealing the passage of air in the space between the roof-supporting surface and the suspended ceiling, while at the same time, the intermediate layer of thermal insulation material forms a continuous layer in this space. At this moment, a shift in dew point is no longer of interest. Due to the insulating effect of this suspended ceiling and the intermediate layer above it, the roof-supporting surface will heat only gradually, so the roof structure and suspended ceiling system has a fire resistance that lasts to 90 minutes or more, i.e., it achieves the fire resistance of concrete systems.

A device is already known for sealing an opening in a fireproof ceiling with a solid member that surrounds it in the form of a frame and at least one fireproof sheet to cover the opening, with an element that holds the sheet directly in the open position inserted between the fireproof sheet and a solid member of the fireproof ceiling, such that said element consists of a substance that melts, dissolves, or otherwise loses its strength under the influence of heat (for example polystyrene foam is suitable for this purpose, German Pat. No. 1,658,786). The surprising advantageous use of such a device according to this invention for solving the dew point problem while at the same time achieving a higher fire resistance class for a roof structure and suspended ceiling system cannot, however, be deduced from this state of the art.

It is advantageous for the ceiling tiles with the intermediate insulation material above them to be held in an upward inclined position on a supporting rail and to be held in this position by at least one element consisting of a material that melts, dissolves, or otherwise loses its strength under the influence of heat and is positioned on the supporting rails. The air passage thus achieved at the predetermined locations is great enough to ventilate the space between the roof-supporting surface and the suspended ceiling adequately. In the event of a fire, the raised ceiling tiles drop into the closing position when their supporting element dissolves, completely sealing the suspended ceiling and not preventing any flow of air into the space between the roof-supporting surface and the suspended ceiling. At the same time, the intermediate layer of insulation material above the ceiling tile is tilted in the direction of the suspended ceiling, forming an essentially continuous intermediate layer of thermal insulation.

It is advantageous for the tilted ceiling tiles to be in guide rails that hold the position closing the suspended ceiling and secure the tiles in a continuous suspended ceiling and continuous intermediate layer in the event of a fire. This can be accomplished by means of guide plates, wire clips, etc. An ornamental grill or a light transmitting grill that allows air to pass through can be placed at those locations where the ceiling tiles are raised so the visual impression of this suspended ceiling will not be impaired by the raised ceiling tiles. When the supporting element melts in the event of a fire, the ceiling tile drops down onto the relatively thin grill, or if the grill itself dissolves due to heat, the ceiling tile will drop down onto the supporting rail, so again, a continuous suspended ceiling is formed, preventing the passage of air into the space between the roof-supporting surface and the suspended ceiling, and maintaining a continuous intermediate layer of thermal insulation.

As mentioned above, the element that melts under the influence of heat should consist of a foam plastic such as polystyrene foam that melts at 70° C. to 80° C.

The roof structure and suspended ceiling system shown in the figures consist of a roof-supporting surface of sheet metal with corrugated reinforcements. A vapor barrier may be provided by the roof-supporting surface itself or it may consist of a layer of asphalt or aluminum foil applied to the roof-supporting surface 4. Above layer 3, there is a layer of thermal insulation 2 which may consist of mineral wool, for example. This layer of thermal insulation 3 is sealed on the outside by a watertight layer 1 which may consist of film or roofing paper.

The ends of T-shaped supporting rails 8 are suspended from the roof-supporting surface 4 with the help of wires 5, the flanges 10 support the ceiling tiles 7 of a suspended ceiling system. Such a suspended ceiling system is also referred to as a strip grid ceiling. An intermediate layer 11 of thermal insulation is applied to the ends 9 of supporting rails 8 and this layer may consist of mineral wool.

At certain locations, a thin grill 15 is laid on the flange 10 of adjacent supporting rails 8. In the area of one supporting rail 8, one edge of a ceiling tile 13 lies on this grill 15, with the tile tilted upward and supported by means of wedge-shaped element 14 that rests on the grill 15 in the area of the adjacent supporting rail 8. Together with the ceiling tile 13, the intermediate layer 16 of insulating material above the ceiling tile is also tilted upward, and for this reason, the intermediate layer 11 is cut along the plane of separation 12.

Owing to the fact that the ceiling tiles 13 are tilted upward, air can flow from space 21 into space 20 and vice versa through the air passage 22 and the grill 15, so that air circulation in space 21 influences space 20 in such a way that despite the intermediate layer 11 of thermal insulation, there cannot be a shift of dew point into the interior of space 20, even under extremely unfavorable weather conditions.

Figure 2:
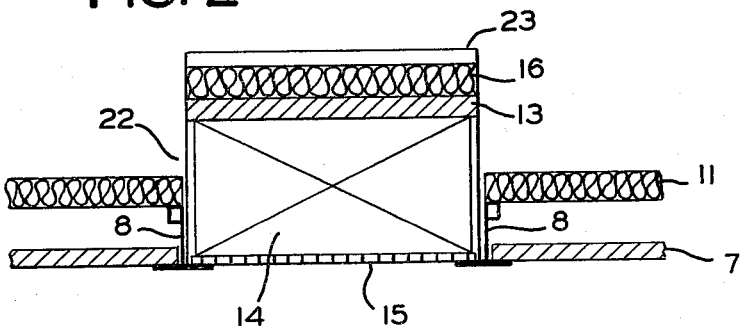
FIG. 2 shows a sectional view of a raised ceiling tile.
Figure 3:
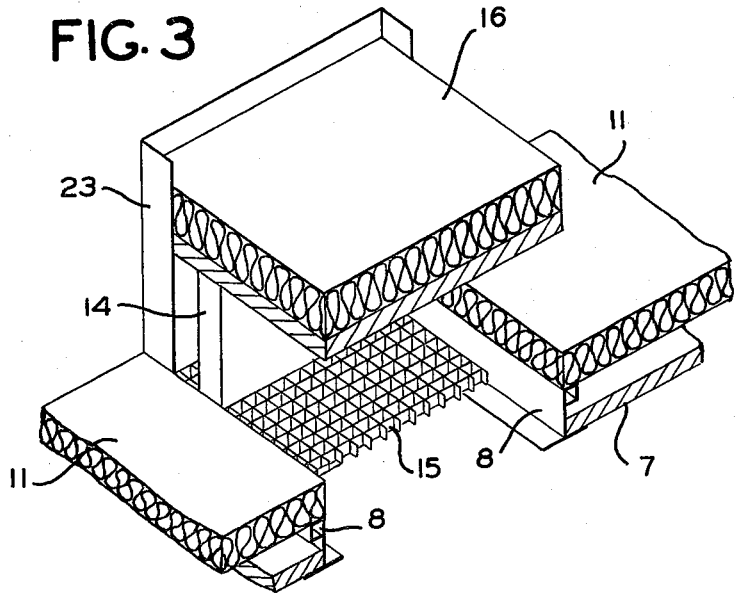
FIG. 3 shows the arrangement in FIG. 2 again in prospective.

The elements 14 that are in the form of a cube in FIGS. 2 and 3, and in the form of a wedge in FIG. 1 consist of a material such as polystyrene foam that melts and dissolves very rapidly under the influence of heat. In the event of a fire in space 21, ceiling tile 13 therefore drops into a horizontal position on the grill 15 when element 14 loses its strength due to heat, or if the grill is made of the same material as element 14 that dissolves under heat and the ceiling tile drops onto the supporting flange of the adjacent supporting rails 8, closing the air passage 22. At the same time, the intermediate layer 16 of insulation material on the ceiling tile 13 also drops into horizontal position, forming a continuous intermediate layer 11. Air is also prevented from passing between spaces 20 and 21. In addition, good thermal insulation of space 20 against space 21 is also achieved, so the roof-supporting surface 4 can heat only very slowly, and roof structure and suspended ceiling system as a whole has a fire resistance according to the 90-minute limitation and even considerably better.

As shown in FIGS. 2 and 3, the ceiling tiles 13 with the intermediate layer 14 of insulation material above them can be raised into vertical position to form the air passage 22 and kept in this position by cubicle elements 14. When these elements 14 dissolve under the influence of heat in the event of a fire in space 21, the ceiling tiles 13 with the intermediate layer 16 of insulation material will drop into the proper closing position in the U-shaped guides 23 at the side under the influence of gravity.

What is claimed is:

1. A roof structure and subceiling assembly consisting of:

(a) a roof structure which is composed of:
  (1) a metal deck,
  (2) over top of the metal deck there being positioned a heat insulating layer,
  (3) over top of the heat insulating layer there being positioned a water impermeable outer layer, (b) below the roof structure there being positioned a suspended ceiling, said suspended ceiling comprising:
  (1) a plurality of suspended support runners,
  (2) positioned on the support runners a plurality of ceiling boards,
  (3) over top of the ceiling boards there being positioned an intermediate heat insulating layer, (c) the improvement comprising:

(1) a plurality of ventilation openings in the suspended ceiling providing for air passage from the area below the suspended ceiling into the area above the suspended ceiling between the suspended ceiling and roof structure, (2) said ventilation openings being capable of being closed by a fire barrier, said fire barrier comprising:

(a) a ceiling board sized to fit within the ventilation opening and having one edge of the ceiling board resting on a support runner in a diagonal position so that the opposite edge of the ceiling board is raised above the plane of the suspended ceiling, said ceiling board being supported in position by a supporting member of a material which will melt, decompose, or otherwise lose its rigidity under the influence of heat so that, after the decomposition of said supporting member, said ceiling board, together with the overlying intermediate layer of heat insulation material will fall into position substantially closing the ventilation opening with ceiling board in position in the plane of the suspended ceiling and the overlying intermediate layer of insulation being placed in position over top of the ceiling board.

2. A roof structure and subceiling assembly consisting of:

(a) a roof structure which is composed of:

(1) a metal deck, (2) over top of the metal deck there being positioned a heat insulating layer, (3) over top of the heat insulating layer there being positioned a water impermeable outer layer, (b) below the roof structure there being positioned a suspended ceiling, said suspended ceiling comprising:

(1) a plurality of suspended support runners, (2) positioned on the supporting runners are a plurality of ceiling boards, (3) over top of the ceiling boards there being positioned an intermediate heat insulating layer, (c) the improvement comprising:

(1) a plurality of ventilation openings in the suspended ceiling providing for air passage from the area below the suspended ceiling into the area above the suspended ceiling between the suspended ceiling and roof structure, (2) a louvre structure placed in each ventilating opening in lieu of a ceiling board and allowing passage of an air current, (3) a ceiling board positioned above the said louvre but permitting passage of air through the louvre into the area above the suspended ceiling, (4) said ceiling board being supported in its raised position above the louvre by a supporting member resting on said louvre, said louvre and/or said supporting member will melt, decompose, or otherwise lose their rigidity upon the influence of heat so that after the decomposition of said louvre and/or said supporting member, said ceiling board will fall into position, substantially closing the ventilation opening.

* * * * *